US006802359B2

(12) United States Patent
Ban

(10) Patent No.: US 6,802,359 B2
(45) Date of Patent: Oct. 12, 2004

(54) REDUCTION CASTING METHOD

(75) Inventor: Keisuke Ban, Nagano-Ken (JP)

(73) Assignee: Nissin Kogyo Co., Ltd., Nagano-Ken (JP)

( * ) Notice: Subject to any disclaimer, the term of this patent is extended or adjusted under 35 U.S.C. 154(b) by 0 days.

(21) Appl. No.: 10/166,743

(22) Filed: Jun. 12, 2002

(65) Prior Publication Data

US 2002/0195221 A1 Dec. 26, 2002

(30) Foreign Application Priority Data

Jun. 20, 2001 (JP) ..... P 2001-186914

(51) Int. Cl.[7] ..... B22D 27/00; B22D 27/18
(52) U.S. Cl. ..... 164/56.1; 164/66.1; 164/67.1
(58) Field of Search ..... 164/55.1, 56.1, 164/57.1, 58.1

(56) References Cited

U.S. PATENT DOCUMENTS 2,770,860 A * 11/1956 Webbere ..... 164/68.1
2,830,894 A * 4/1958 Spedding et al. ..... 75/399
6,171,363 B1 * 1/2001 Shekhter et al. ..... 75/369

FOREIGN PATENT DOCUMENTS

JP 03-230843 10/1991
JP 2000-280063 * 10/2000

* cited by examiner

*Primary Examiner*—Kuang Y. Lin
(74) *Attorney, Agent, or Firm*—McGuireWoods LLP

(57) ABSTRACT

In a reduction casting method in which casting is performed while an oxide film formed on a surface of the molten metal is reduced, after an inside of a cavity of a molding die is allowed to be in a non-oxidizing atmosphere, a reducing substance having a stronger reducing property than a metal of the molten metal has is allowed to act on the molten metal whereupon casting is performed while the oxide film formed on the surface of the molten metal is reduced.

35 Claims, 1 Drawing Sheet

REDUCTION CASTING METHOD

BACKGROUND OF THE INVENTION

1. Technical Field to which the Invention Belongs

The present invention relates to a reduction casting method in which casting is performed while an oxide film formed on a surface of molten metal at the time of casting is reduced.

2. Prior Art

There are various types of casting methods such as a gravity casting method (GDC), a low pressure die casting method (LPDC), a die casting method (DC), a squeeze casting method (SC), a thixomolding method and the like. All of these methods perform casting by pouring molten metal into a cavity of a molding die thereby molding it into a predetermined shape. In these casting methods, it has been a problem that, in a method among these casting methods in which an oxide film is likely to be formed on a surface of the molten metal, for example, at aluminum casting or the like, a surface tension of the molten metal is increased by the oxide film formed on the surface of the molten metal to deteriorate a flowing property, a running property and an adhesive property of the molten metal thereby causing casting imperfections such as insufficient filling, a surface fold and the like.

SUMMARY OF THE INVENTION

The present invention is attained in order to solve these problems and has an object to provide a reduction casting method which is capable of performing favorable casting by reducing an oxide film formed on a surface of the molten metal.

Further, it is an object of the present invention to provide a reduction casing method by which a cast product having an excellent appearance can be produced in an easy manner and also constitution of a casting apparatus can be simplified.

As a method to solve these problems, the present applicant has developed a method of performing casting by a reduction casting method while an oxide film formed on a surface of molten metal of aluminum is reduced. In this reduction casting method, a magnesium-nitrogen compound ($Mg_3N_2$) having a strong reducing property is prepared by using a nitrogen gas and a magnesium gas and, then, casting is performed while the thus-prepared magnesium-nitrogen compound is allowed to act on the molten metal of aluminum to reduce the oxide film formed on the surface of the molten metal. By pouring the molten metal into a cavity of a molding die in a state in which the magnesium-nitrogen compound is deposited on a surface of the cavity of the molding die, when the molten metal comes into contact with the surface of the cavity, the oxide film formed on the surface of the molten metal is reduced to decrease a surface tension of the molten metal thereby enhancing a flowing property and a wetting property of the molten metal whereupon a cast product which does not have a cast imperfection but has an excellent appearance deprived of a surface fold or the like can easily be produced.

The reduction casting method is characterized in that casting is performed by allowing a reducing compound such as a magnesium-nitrogen compound to act on molten metal to reduce an oxide film formed on a surface of the molten metal. To this end, at the time of performing casting, a magnesium metal and a nitrogen gas are reacted with each other to prepare a magnesium-nitrogen compound and, then, the thus-prepared magnesium-nitrogen compound is allowed to act on the molten metal. As a method of preparing the magnesium-nitrogen compound, there are one method in which the magnesium-nitrogen compound is prepared in advance in a furnace or the like arranged separately from a molding die and the other method in which the nitrogen gas and a magnesium gas are each individually introduced inside the cavity and, then, the magnesium-nitrogen compound is prepared in the cavity.

In either method, the magnesium metal is heated to allow it to be a magnesium gas and, then, the thus-prepared magnesium gas is allowed to react with the nitrogen gas to prepare the magnesium-nitrogen compound. Because of an extremely strong reducing property of the magnesium-nitrogen compound, it is necessary that the magnesium-nitrogen compound is treated under a non-oxidizing atmosphere at both stages of preparing it and of allowing it o act on the molten metal. While, in a conventional reduction casting method, a metallic gas and the nitrogen gas are used as in a case in which the magnesium gas and the nitrogen gas are r acted with each other to prepare the magnesium-nitrogen compound. As described above, it is necessary in the reduction casting method that the reducing property of the reducing compound i not impaired whereupon much attention must be paid in casting operation compared with an ordinary casting apparatus. Therefore, it is desirous that, in a case in which a constitution or the like of the apparatus can be as simple as possible, not only the constitution of the apparatus can be simplified, but also the casting operation can be conducted in a convenient manner.

The present invention is made to achieve the above-mentioned desires thus found by the inventor.

That is, the afore-mentioned desires can be achieved by a reduction casting method for performing casting while an oxide film formed on a surface of molten metal is reduced, according to the present invention, comprising the steps of:

allowing an inside of a cavity of a molding die to be in a non-oxidizing atmosphere;

allowing a reducing substance having a stronger reducing property than a metal of the molten metal has to act on the molten metal; and performing casting while the oxide film formed on the surface of the molten metal is reduced.

Further, according to present invention, it is preferable that the reducing substance is transferred by a carrier gas that does not react with the reducing substance to allow the reducing substance to act on the molten metal.

Further, according to the present invention, as a method of allowing the inside of the cavity of the molding die to be in the non-oxidizing atmosphere, it is preferable that the carrier gas that does not react with the reducing substance is introduced into the inside of the cavity to replace an acidic atmosphere inside the cavity therewith.

Further, according to the present invention, as a method of allowing the inside of the cavity of the molding die to be in the non-oxidizing atmosphere, it is preferable that the inside of the cavity is subjected to vacuum suction.

Further, according to the present invention, it is preferable that a metallic gas is used as the reducing substance.

Further, according to the invention, there is provided the reduction casting method, in which favorable aluminum casting can be performed by using the molten metal of aluminum or an alloy thereof as the molten metal and using a magnesium gas as the reducing substance.

Further, according to the invention, an argon gas is favorably used as a carrier gas of the magnesium gas.

DETAILED DESCRIPTION OF THE PREFERRED EMBODIMENTS

Figure 1:
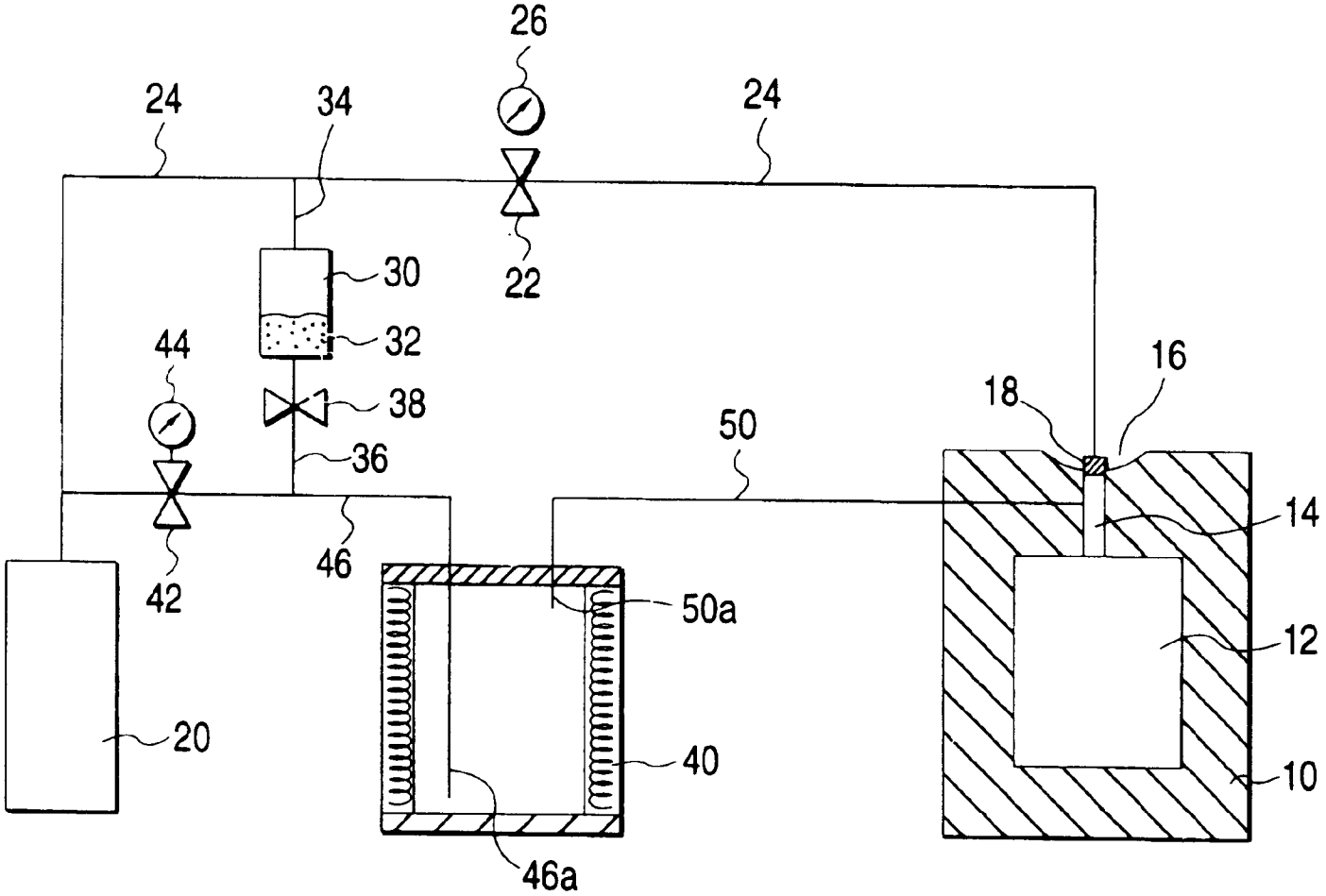
FIG. 1 is an explanatory diagram showing an entire constitution of a casting apparatus which performs casting by utilizing a casting method according to the present invention.

Hereinafter, a preferred embodiment of the present invention will be described in detail with reference to accompanying drawings.

FIG. 1 is an explanatory diagram showing an entire constitution of a casting apparatus for performing casting by using a reduction casting method according to the present invention. Hereinafter, an application thereof for aluminum casting is illustrated; however, the invention is by no means limited to the aluminum casting.

In FIG. 1, a reference number 10 represents a molding die; a reference number 12 represents a cavity; a reference number 14 represents a runner; a reference number 16 represents a sprue; and a reference number 18 represents a stopper for opening/closing an opening portion of the runner 14. By opening the stopper 18, molten metal of aluminum is poured from the sprue 16 into the cavity 12 and, then, the thus-poured molten metal can be cast into a predetermined shape by being solidified in the cavity 12.

A reference number 20 represents a steel cylinder containing an argon gas for being supplied as a carrier gas. The steel cylinder 20 containing the argon gas communicates with the cavity 12 of the molding die 10 via a piping system 24 in which a valve 22 is interposed. A reference number 26 represents a flow meter.

The reference number 30 represents a supply tank of a metal which, in the present embodiment, contains magnesium powders 32. The supply tank 30 communicates, on one hand, with the piping system 24 which communicates with the steel cylinder 20 containing the argon gas at a position in an upstream side of the valve 22 via a piping system 34 and, on the other hand, with a piping system 46 which communicates with both a furnace 40 and the steel cylinder 20 containing the argon gas at a position in the middle thereof via a piping system 36. A reference number 38 represents a valve interposed in the middle of the piping system 36.

A reference number 40 represents a furnace for generating a metallic gas by heating a metal. In the present embodiment, a temperature inside the furnace 40 is set to be 800° C. or more that is a temperature at which magnesium powders 32 are sublimed.

The steel cylinder 20 containing the argon gas and the furnace 40 are communicated with each other through the piping system 46 in which a valve 42 is interposed. The piping system 46 is arranged such that a distal end 46*a* thereof extends to a neighborhood of a bottom portion of the furnace 40 inside the furnace 40. The valve 42 is arranged in the piping system 46 at a position in an upstream side of a joint between the piping system 36 and the piping system 46. A reference number 44 represents a flow meter.

The furnace 40 and the molding die 10 communicate with each other via a piping system 50. A proximal end 50*a* of the piping system 50 is disposed at an upper portion of the furnace 40 inside the furnace 40 while a distal end of the piping system 50 is connected with the runner 14 of the molding die 10.

A reduction casting of aluminum by using the casting apparatus according to the present embodiment is performed as described below.

Firstly, the valve 22 is opened in a state in which the valve 38 and the valve 42 are closed to allow the argon gas to be flowed from the steel cylinder 20 containing the argon gas into the cavity 12 of the molding die 10 thereby discharging an air present in the cavity 12 whereupon the inside of the cavity is allowed to be in a non-oxidizing atmosphere. A flow quantity of the argon gas to be flowed into the cavity 12 by this operation can be controlled by the flow meter 26. In a state in which the argon gas is filled inside the cavity 12 thereby allowing the inside of the cavity 12 to be in the non-oxidizing atmosphere, the runner 14 is sealed by the stopper 18.

As a method of allowing the inside of the cavity 12 to be in the non-oxidizing atmosphere, except for such a method as in the present embodiment in which an air in the cavity 12 is discharged by allowing the non-oxidizing argon gas to flow thereinto, a method in which the inside of the cavity 12 is subjected to vacuum suction by a vacuum device to discharge the air in the cavity 12 thereby allowing the inside of the cavity 12 to be in the non-oxidizing atmosphere is also possible. At the time the cavity 12 is exhausted by the vacuum device, such an exhausting operation is performed in a state in which the cavity 12 is hermetically sealed by sealing a vent hole (not shown) provided in the molding die 10.

Next, the valve 22 and the valve 42 are closed and, then, the valve 38 is opened to allow the argon gas to flow from the steel cylinder 20 containing the argon gas to the supply tank 30 thereby supplying the magnesium powders 32 into the furnace 40. Further, when the magnesium powders 32 are supplied into the furnace 40, it is necessary that an inside of the furnace 40 is allowed to be in a non-oxidizing atmosphere beforehand. To this end, the valve 42 is opened in a state in which the valve 22 and the valve 38 are closed to allow the argon gas to flow from the steep cylinder 20 containing the argon gas into the furnace 40 thereby discharging the air inside the furnace 40 and, thereafter, the magnesium powders 32 are supplied into the furnace 40.

Further, instead of allowing the inside of the furnace 40 to be in the non-oxidizing atmosphere by allowing the argon gas to flow into the furnace 40 every time the magnesium powders 32 are supplied into the furnace 40, it is possible that a valve is interposed in the piping system 50 and, then, by appropriately opening/closing the thus-interposed valve, the inside of the furnace 40 is continuously blocked from outside to maintain the non-oxidizing atmosphere therein.

After the magnesium powders 32 are supplied into the furnace 40, the valve 38 is closed. In the furnace 40, the magnesium powders 32 are sublimed by heating to be a magnesium gas.

In the present embodiment, this magnesium gas acts as a reducing substance.

Next, the valve 42 is opened to allow the argon gas to flow from the steel cylinder 20 containing the argon gas into the furnace 40 and, then, the magnesium gas in the furnace 40 is sent into the cavity 12 of the molding die 10 using the argon gas as a carrier gas. When the magnesium gas in the furnace 40 is sent into the cavity 12 of the molding die 10 by using the argon gas as the carrier gas, a flow quantity of the argon gas is monitored by the flow meter 44 whereupon the flow quantity can appropriately be controlled.

Further, when the magnesium gas is introduced into the cavity 12 of the molding die 10, it is an ordinary method that the magnesium gas is generated by using the furnace 40 and, then, the thus-generated magnesium gas is introduced into the cavity 12 by using a carrier gas such as the argon gas or the like. Furthermore, as a method of supplying the magnesium gas from the furnace 40 into the cavity 12, there are a method in which a given quantity of magnesium powders are supplied from the supply tank 30 into the furnace 40 to generate the magnesium gas every time a casting operation is performed, another method in which, when a quantity thereof to be supplied from the furnace 40 into the cavity 12 is controlled by controlling a flow quantity of the carrier gas, and other methods. When the supply quantity of the magnesium gas is controlled by the flow quantity of the carrier gas, magnesium may continuously be supplied into the furnace 40. It goes without saying that magnesium may be supplied not only in a powder state, but also in a granular state, a small piece state and the like. On this occasion, magnesium becomes in a molten state in the furnace 40.

After the magnesium gas is introduced into the cavity 12 of the molding die 10, the molten metal of aluminum is poured from the sprue 16 into the cavity 12 via the runner 14. By removing the stopper 18 from the runner 14, the molten metal is poured from the sprue 16 into the cavity 12.

The molten metal of aluminum which is poured from the runner 14 into the cavity 12 is to fill the cavity 12 in a gradual manner; on this occasion, since magnesium has a stronger oxidizing activity than aluminum has, the oxide film formed on the surface of the molten metal of aluminum is reduced by an action of the magnesium gas introduced in the cavity 12, the oxide film is deprived of oxygen, and the surface of the molten metal is reduced to be pure aluminum whereupon casting is performed (reduction casting method).

While the inside of the cavity 12 is allowed to be in the non-oxidizing atmosphere beforehand, oxygen remaining in the cavity 12 reacts with the magnesium gas to form magnesium oxide or magnesium hydroxide which is then taken in the molten metal. Oxygen remaining in the cavity 12 is small in quantity and, therefore, magnesium oxide or magnesium hydroxide to be formed is also small in quantity and, since any of these compounds is a stable compound, these compounds have no adverse effect on a quality of aluminum cast product.

According to the present embodiment, magnesium gas acting as a reducing substance deprives the oxide film formed on the surface of the molten metal of aluminum of oxygen to allow the surface of the molten metal of aluminum to be pure aluminum whereupon casting is performed. Under an atmospheric pressure, the molten metal of aluminum is extremely easily oxidized whereupon the surface tension thereof is increased to a great extent by the oxide film formed on the surface of the molten metal to interfere with the running property and the like of the molten metal, while, according to the present embodiment, by allowing the surface of the molten metal of aluminum to be pure aluminum, the surface tension of the molten metal is decreased and, accordingly, the wetting property and the running property of the molten metal become favorable as well as the transferring property (flatness) relative to the surface of the inner wall of the cavity 12 is enhanced to enable a cast product excellent in the appearance having no surface fold or the like to be obtained. Further, since a filling property of the molten metal becomes favorable, imperfections such as insufficient filling and the like can be avoided whereupon an operation of filling the molten metal into the cavity 12 can be conducted in a short period of time (a few seconds).

Although the above-described embodiment illustrates an application of aluminum casting, the invention can also be applied to casting of an aluminum alloy. Further, the invention can favorably be utilized for casting other metals than aluminum such as magnesium, iron and the like, as well as alloys thereof.

Although, in the above-described embodiment, the magnesium gas is allowed to act on the molten metal of aluminum as a reducing substance, the reducing substance is not limited to the magnesium gas so long as it has an action of reducing the oxide film formed on the surface of the molten metal, but an appropriate metallic gas or an appropriate compound can be used. Further, the reducing substance may be of any type so long as it has an action of reducing the oxide film formed on the surface of the molten metal whereupon a reducing characteristic thereof is selected in relation with a metal to be used in casting. Furthermore, as the reducing substance, a metal or a compound which can be turned to be in a gaseous state or a particulate state by heating so that it can be easily transferred by a carrier gas is advantageously used.

In the reduction casting method according to the present invention, as described above, by allowing the reducing substance to act on the molten metal after the cavity is allowed to be in the non-oxidizing atmosphere, casting can be performed while the oxide film formed on the surface of the molten metal is reduced; on this occasion, the surface tension of the molten metal can be decreased thereby enhancing the flowing property of the molten metal and the wetting property thereof relative to the molding die. By these features, the running property of the molten metal becomes favorable to decrease or even eliminate a heat retaining treatment or use of a heat-insulating die releasing agent whereupon a casting method which is of a low cost and a high quality is allowed to be provided. Further, since the reducing action is performed on the molten metal, the invention has an effect such that it is not necessary to prepare the reducing compound by reacting the metallic gas with the nitrogen gas whereby not only the constitution of the casting apparatus can be simplified, but also the casting operation can be conducted in a convenient manner.

What is claimed is:

1. A reduction casting method for performing casting while an oxide film formed on a surface of molten metal is reduced, comprising:

allowing an inside of a cavity of a molding die to be in a non-oxidizing atmosphere;

allowing a reducing substance in a non-oxidizing atmosphere in a heated receptacle to be transferred to the inside of the cavity, the reducing substance having a stronger reducing property than a metal of said molten metal has to act on them molten metal;

providing a non-active carrier gas into the heated receptacle to transfer the reducing substance from the heated receptacle to the inside of the cavity; and performing casting while the oxide film formed on the surface of the molten metal is reduced.

2. The reduction casting method as set forth in claim 1, wherein the non-active carrier gas does not react with the reducing substance to allow the reducing substance to act on the molten metal.

3. The reduction casting method as set forth in claim 1, wherein, as a method of allowing the inside of the cavity of the molding die to be in the non-oxidizing atmosphere, the non-active carrier gas which does not react with the reducing substance is introduced into the inside of said cavity to replace an acidic atmosphere inside the cavity therewith.

4. The reduction casting method as set forth in claim 1, wherein, as a method of allowing the inside of the cavity of the molding die to be in the non-oxidizing atmosphere, the non-active carrier gas does not react with the reducing substance is introduced into the inside of said cavity to replace an acidic atmosphere inside the cavity therewith.

5. The reduction casting method as set forth in claim 1, wherein as a method of allowing the inside of the cavity of the molding die to be in the non-oxidizing atmosphere, the inside of said cavity is subjected to vacuum suction.

6. The reduction casting method as set forth in claim 2, wherein as a method of allowing the inside of the cavity of the molding die to be in the non-oxidizing atmosphere, the inside of said cavity is subjected to vacuum suction.

7. The reduction casting method as set forth in claim 1, wherein a metallic gas is used as the reducing substance.

8. The reduction casting method as set forth in claim 2, wherein a metallic gas is used as the reducing substance.

9. The reduction casting method as set forth in claim 3, wherein a metallic gas is used as the reducing substance.

10. The reduction casting method as set forth in claim 4, wherein a metallic gas is used as the reducing substance.

11. The reduction casting method as set forth in claim 5, wherein a metallic gas is used as the reducing substance.

12. The reduction casting method as set forth in claim 6, wherein a metallic gas is used as the reducing substance.

13. The reduction casting method as set forth in claim 1, wherein aluminum is used as the molten metal and a magnesium gas is used as the reducing substance.

14. The reduction casting method as set forth in claim 2, wherein aluminum is used as the molten metal and a magnesium gas is used as the reducing substance.

15. The reduction casting method as set forth in claim 3, wherein aluminum is used as the molten metal and a magnesium gas is used as the reducing substance.

16. The reduction casting method as set forth in claim 4, wherein aluminum is used as the molten metal and a magnesium gas is used as the reducing substance.

17. The reduction casting method as set forth in claim 5, wherein aluminum is used as the molten metal and a magnesium gas is used as the reducing substance.

18. The reduction casting method as set forth in claim 6, wherein aluminum is used as the molten metal and a magnesium gas is used as the reducing substance.

19. The reduction casting method as set forth in claim 13, wherein an argon gas is used as the non-active carrier gas of the magnesium gas.

20. The reduction casting method as set forth in claim 14, wherein an argon gas is used as the non-active carrier gas of the magnesium gas.

21. The reduction casting method as set forth in claim 15, wherein an argon gas is used as the non-active carrier gas of the magnesium gas.

22. The reduction casting method as set forth in claim 16, wherein an argon gas is used as the non-active carrier gas of the magnesium gas.

23. The reduction casting method as set forth in claim 17, wherein an argon gas is used as the non-active carrier gas of the magnesium gas.

24. The reduction casting method as set forth in claim 18, wherein an argon gas is used as the non-active carrier gas of the magnesium gas.

25. The reduction casting method as set forth in claim 1, wherein the reducing substance is transferred to the inside of the cavity prior to the performing step.

26. The reduction casting method as set forth in claim 25, wherein the reducing substance is a metallic gas.

27. The reduction casting method as set forth in claim 26, wherein the metallic gas is magnesium gas.

28. The reduction casting method as set forth in claim 1, wherein the reducing agent consists of a metallic gas.

29. The reduction casting method as set forth in claim 28, wherein the metallic gas is magnesium gas.

30. The reduction casting method as set forth in claim 1, wherein the heated receptacle is a heater.

31. A reduction casting method for performing casting while an oxide film formed on a surface of molten metal is reduced, comprising:

allowing a reducing substance in a heated receptacle in a non-oxidizing atmosphere to be transferred to an inside of a cavity of a molding die;

providing a carrier gas, which does not react with the reducing substance, into the heated receptacle to transfer the reducing substance from the heated receptacle to the inside of the cavity; and performing casting while the oxide film formed on the surface of the molten metal is reduced.

32. The reduction casting method as set forth in claim 31, wherein the carrier gas is a non-active carrier gas.

33. The reduction casting method as set forth in claim 31, further comprising the step of allowing an inside of the cavity of a molding die to be in non-oxidizing atmosphere.

34. A reduction casting method for performing casting while an oxide film formed on a surface of molten metal is reduced comprising:

providing a stable reducing substance in a heated receptacle prior to being transferred to an inside of a cavity of a molding die;

providing a carrier gas, which does not react with the stable reducing substance, into the heated receptacle to transfer the stable reducing substance from the heated receptacle to the inside of the cavity; and performing casting while the oxide filmed formed on the surface of the molten metal is reduced by the stable reducing substance in the cavity.

35. The reduction casting method as set forth in claim 34, wherein the stable reducing substance is one of a metal and a compound which can be turned to a gaseous state or a particulate state by heating.

* * * * *